US006954946B2

(12) United States Patent
Goldfarb et al.

(10) Patent No.: US 6,954,946 B2
(45) Date of Patent: Oct. 18, 2005

(54) BELTS AND METHODS OF USING BELTS

(75) Inventors: Talia Bahr Goldfarb, St. Louis, MO (US); Danielle Bahr Eason, Bethesda, MD (US); Charles Alan Goldfarb, St. Louis, MO (US)

(73) Assignee: Myself Designs, LLC, St. Louis, MO (US)

( * ) Notice: Subject to any disclaimer, the term of this patent is extended or adjusted under 35 U.S.C. 154(b) by 0 days.

(21) Appl. No.: 10/792,978

(22) Filed: Mar. 4, 2004

(65) Prior Publication Data

US 2005/0039244 A1 Feb. 24, 2005

Related U.S. Application Data

(60) Provisional application No. 60/496,767, filed on Aug. 21, 2003.

(51) Int. Cl.[7] ..... A41F 15/00
(52) U.S. Cl. ..... 2/338
(58) Field of Search ..... 2/338, 310, 335, 2/311–325, 334, 22, 76, 79, 78.3, 227, 236, 2/237, 242

(56) References Cited

U.S. PATENT DOCUMENTS 863,716 A * 8/1907 Hunter ..... 2/237
1,607,156 A 11/1926 Godshaw
2,923,009 A 2/1960 Cookman
3,848,270 A 11/1974 Rand
4,800,594 A 1/1989 Young
4,999,853 A 3/1991 Tanner
5,566,397 A 10/1996 Scott
5,575,011 A * 11/1996 Allen ..... 2/227
5,852,829 A 12/1998 Relaford
6,779,201 B1 * 8/2004 Pfrommer ..... 2/321
2003/0182715 A1 10/2003 Wallace

FOREIGN PATENT DOCUMENTS

WO WO/2005/023027 3/2005

OTHER PUBLICATIONS http://www.beltkro.com/, 7 pages, accessed May 23, 2005.

* cited by examiner

*Primary Examiner*—Tejash Patel
(74) *Attorney, Agent, or Firm*—Harness, Dickey & Pierce, P.L.C.

(57) ABSTRACT

The present invention relates to belts which are fastenable with one hand and method of using such belts. In an exemplary implementation, a method generally includes anchoring a first end portion of the belt to a belt loop, positioning the belt through the other belt loops, and fastening the belt by using only one hand to engage a second end portion of the belt with the first end portion. The first end portion can be anchored to the belt loop by looping the first end portion generally about a belt loop, and then engaging the first end portion upon itself.

31 Claims, 5 Drawing Sheets

BELTS AND METHODS OF USING BELTS

CROSS-REFERENCE TO RELATED APPLICATION

This application claims priority to U.S. Provisional Application No. 60/496,767, filed Aug. 21, 2003, the contents of which are incorporated herein by reference in their entirety.

FIELD

The present invention relates generally to belts for use with garments such as pants, trousers, dresses, skirts, and the like which include belt loops. More particularly (but not exclusively), the present invention relates to belts which can be fastened and/or unfastened with only one hand.

BACKGROUND

Traditional belts usually require the wearer to use both hands to fasten or unfasten the belt. This feat can be especially difficult, if not impossible, for many elderly persons, children, and other persons having disabilities affecting bi-manual dexterity. Such persons may not be able to undress and redress (e.g., to visit a restroom, etc) absent taking an aide with them, which can be particularly disruptive of personal independence and significantly inhibit the range of normal activities in which the person can independently participate without assistance.

By way of example, young children during their toddler and preschool years are often striving to become more independent. One of the main focal points of such independence is potty training. Once potty trained, however, pants previously held up by a bulky diaper can slip down. Furthering this problem, toddlers often pull their pants down without unbuttoning or unsnapping their pants. This can lead to stretched out waist bands that are unable to keep pants up and properly positioned around the waist region of the wearer. Toddlers also frequently wear highly elasticized pants to avoid the fastening and unfastening challenges associated with traditional belts.

SUMMARY

An exemplary embodiment includes a belt for use with a garment having a plurality of belt loops. The belt generally includes generally opposed first and second end portions. The first end portion is adapted to be looped generally about a belt loop and engaged upon itself. The belt is sized to be positioned through the garment's other belt loops. The second end portion is engageable with the first end portion to enable fastening of the belt with only one hand.

Another exemplary implementation includes a method of using a belt with a garment having a plurality of belt loops. The method generally includes anchoring a first end portion of the belt to a belt loop, positioning the belt through the garment's other belt loops, and fastening the belt by using only one hand to engage a second end portion of the belt with the first end portion.

Further areas of applicability of the present invention will become apparent from the detailed description provided hereinafter. It should be understood that the detailed description and specific examples, while indicating at least one exemplary embodiment of the invention, are intended for purposes of illustration only and are not intended to limit the scope of the invention.

BRIEF DESCRIPTION OF THE DRAWINGS

The present invention will be more fully understood from the detailed description and the accompanying drawings, wherein.

Corresponding reference characters indicate corresponding features throughout the drawings.

DETAILED DESCRIPTION OF EXEMPLARY EMBODIMENTS

Figure 1:
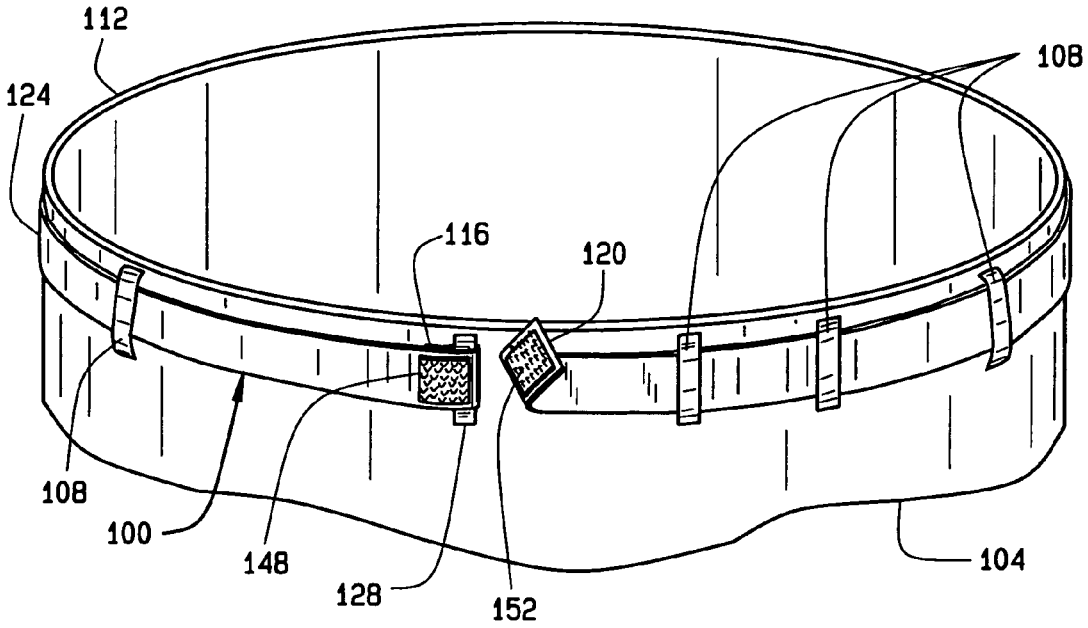
FIG. 1 is a perspective view of a belt being used with a garment according to an exemplary embodiment of the invention.
Figure 2:
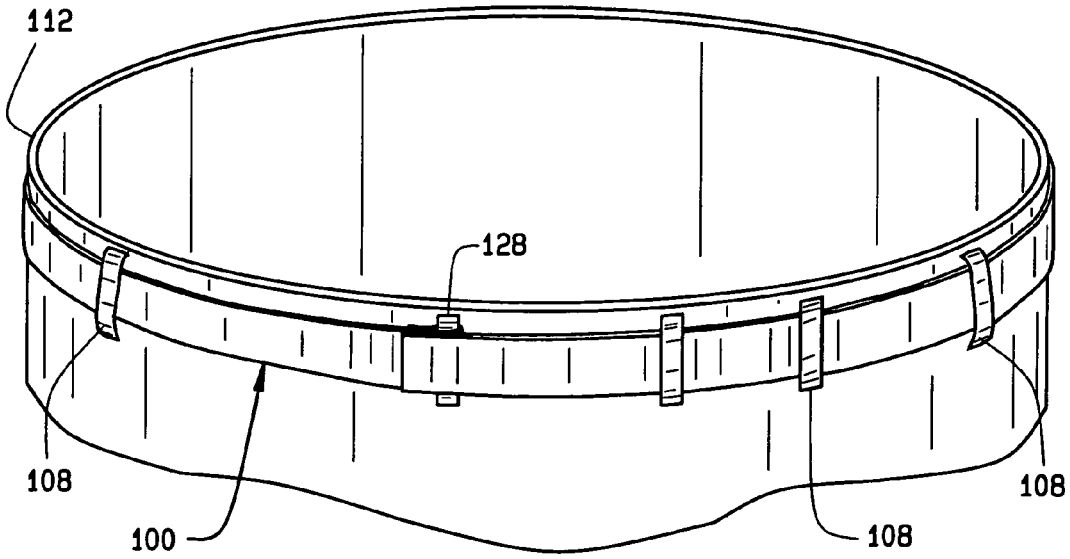
FIG. 2 is a perspective view of the belt and garment shown in FIG. 1 wherein the belt is fastened about the garment.

The following description of the exemplary embodiments is merely exemplary in nature and is in no way intended to limit the invention, its application, or uses.

According to one aspect, the invention provides belts for use with garments having a plurality of belt loops. In an exemplary embodiment, the belt generally includes generally opposed first and second end portions. The first end portion is adapted to be looped generally about one of the garment's belt loops and then engaged upon itself. The belt is sized to be positioned through the garment's other belt loops. The second end portion is engageable with the first end portion to enable fastening of the belt with only one hand.

Another aspect of the invention provides methods of using a belt with a garment having a plurality of belt loops. In an exemplary implementation, a method generally includes anchoring a first end portion of the belt to one of the garment's belt loops, positioning the belt through the garment's other belt loops, and fastening the belt by using only one hand to engage a second end portion of the belt with the first end portion.

By providing belts that can relatively easily be fastened or unfastened while using only one hand, various implementations of the invention can allow persons having limited or no bi-manual dexterity (e.g., from disabilities due illness, age, or other causes) to participate in a greater range of normal activities without, or at least with less, assistance. For example, implementations of the present invention can allow disabled persons to wear more conventional garments and/or use a restroom independently as a result of being able to lower, raise, and adjust their pants on their own.

FIGS. 1 through 6 illustrate an exemplary belt 100 in accordance with the principles of this invention. As shown is FIG. 1, the belt 100 can be used in conjunction with a pair of pants 104 including a plurality of external belt loops 108 along a waist region 112 of the pants 104. The belt 100 can also be used with a wide range of other garments such as shorts, trousers, dresses, skirts, and the like.

The belt 100 includes generally opposed first and second end portions 116 and 120, and a medial portion 124 therebetween. The first end portion 116 is anchored or grounded to the belt loop 128. The medial portion 124 of the belt 100 is positioned through the remaining belt loops 108 such that the belt 100 extends generally around the waist region 112 of the pants 104.

It should be noted that the belt 100 need not be positioned through each and every remaining belt loop 108, as it is quite common for belt loops to be missed or skipped when putting a belt on. While some embodiments include anchoring the first end portion 116 to the belt loop 128 and then threading the second end portion 120 of the belt 100 through the other belt loops 108, such is not required. For example, alternative embodiments can include threading the first end portion 116 through the belts loops 108 to position the belt 108 generally around the waist region 112, and then anchoring the first end portion 116 to the belt loop 128.

Figure 5:
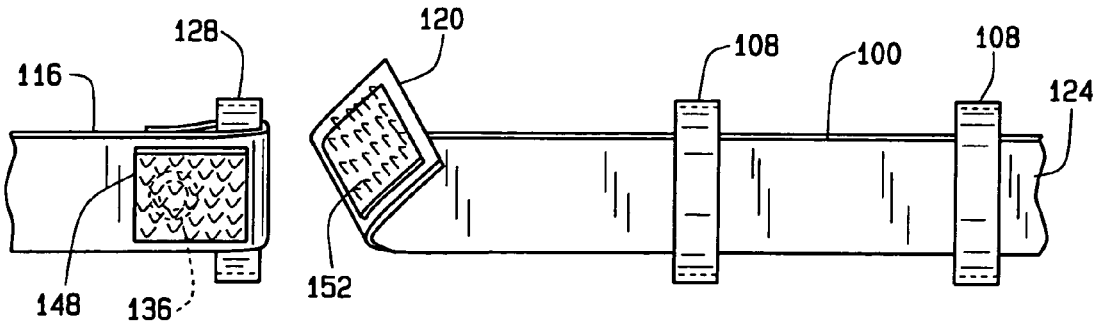
FIG. 5 is a partial view of the belt shown in FIG. 3 illustrating the belt's end portions.
Figure 6:
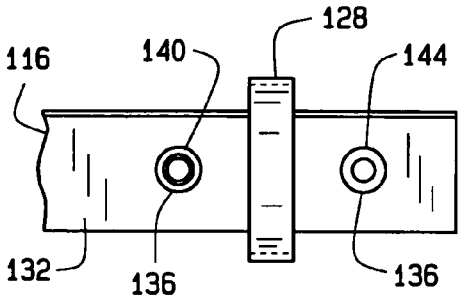
FIG. 6 is a view of a belt end portion inserted through but not yet looped around a belt loop according to an exemplary embodiment of the invention.

As shown in FIGS. 5 and 6, the first end portion 116 is looped generally about the belt loop 128. The first end portion 116 is then engaged upon itself with a suitable fastening means (e.g., snaps, buttons, clasps, Velcro® hook and loop closures, magnets, buckles, etc.) to thereby anchor or ground the first end portion 116 to the belt loop 128.

While the first end portion 116 is shown in FIG. 1 as being anchored to only one belt loop 128 on the right side of the pants 104 taken from the perspective of the wearer, such is not required. For example, an alternative embodiment includes a first end portion of a belt that is anchored to the first belt loop on the left side of pants. Yet another embodiment includes a belt having a first end portion that is anchored (e.g., looped around, etc.) to two or more belt loops.

With further reference to FIGS. 5 and 6, the first end portion 116 is looped upon itself in a direction generally inwardly towards the pants 104. The first end portion 116 is then engaged upon itself with a suitable fastening means disposed on a back surface 132 of the belt 100. Alternatively, the first end portion can instead be looped upon itself in the opposite direction which is generally outwardly away from the pants. The first end portion can then be engaged upon itself with suitable fastening means disposed on the front surface of the belt.

Figure 7:
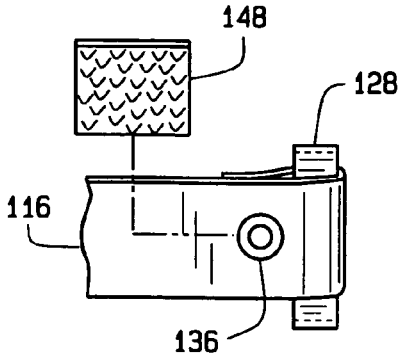
FIG. 7 is an exploded view of the belt end portion shown in FIG. 6 looped around the belt loop and engaged upon itself wherein a fastener portion is removed for clarity to show a portion of a snap used to anchor the end portion to the belt loop.

With further reference to FIGS. 5 through 7, the first end portion 116 is engaged upon itself with a snap 136. The snap 136 can be formed of two corresponding male and female snap members 140 and 144, which can be snapped together after the first end portion 116 has been looped upon itself. Preferably, the belt 100 is adapted such that the second end portion 120, when engaged with the first end portion 116, covers up or conceals the anchoring snap 136 (FIGS. 2 and 4) or other device used to anchor the first end portion 116 to the belt loop 128.

Figure 8:
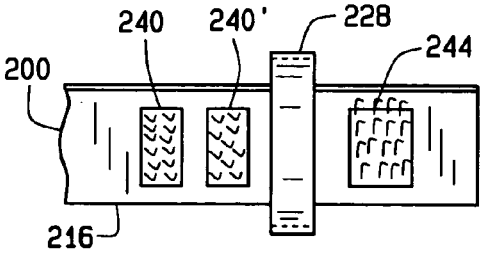
FIG. 8 is a view of a belt end portion inserted through but not yet looped around a belt loop wherein the belt end portion includes two hook and loop fastening options that allow adjustment of the functional length of the belt according to an exemplary embodiment of the invention.

Alternatively, a wide range of other suitable devices and methods can be employed for engaging the first end portion 116 upon itself, such as hook and loop closures (e.g., Velcro® hook and loop fasteners, etc.), magnets, clasps, buttons, latches, etc. For example, FIG. 8 illustrates a first end portion 216 of a belt 200 that includes corresponding strips or patches 240, 240' and 244 of a hook and loop fastening system (e.g., Velcro® hook and loop fasteners, etc.) for engaging the first end portion 216 upon itself after being looped through a belt loop 228.

The belt can also include means for selectively adjusting the functional or operational length of the belt. The functional length of the belt is determined in part by the length of the first end portion that is looped and engaged upon itself. Increasing the length of the first end portion that is looped and engaged upon itself decreases the functional length of the belt, and vice versa. For example, the first end portion can include any suitable number of (i.e., one or more) strips of a hook and loop closure system dimensionally sized to allow varying lengths of the first end portion to be looped and engaged upon itself. In an exemplary embodiment, a belt can include a first end portion which has a single generally continuous Velcro® strip extending along the substantial entirety of the length of the first end portion.

Figure 9:
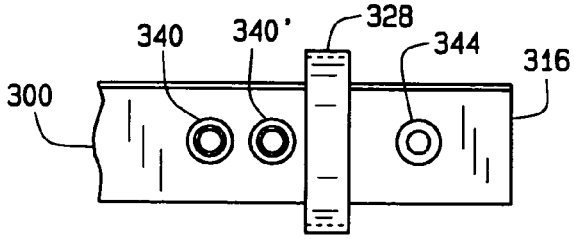
FIG. 9 is a view of a belt end portion inserted through but not yet looped around a belt loop wherein the belt end portion includes two snap options that allow adjustment of the functional length of the belt according to an exemplary embodiment of the invention.

As another example, the first end portion can be provided with more than one engagement option. That is, the first end portion can include a first connector portion and various other connector portions which are engageable with the first connector portion and which are spaced apart from one another along a length of the first end portion. FIG. 9 illustrates an exemplary embodiment of a first end portion 316 of a belt 300 that includes two snap options 340 and 340'. The snap options 340 and 340' are spaced apart from one another along a length of the first end portion 316 to accommodate adjusting of the functional length of the belt 300. The functional length of the belt can be adjusted by choosing to engage the snap portion 344 with either snap option 340 or 340'. For example, looping the first end portion 320 around the belt loop 328 and then engaging snap portions 340' and 344 with one another provides a greater functional length for the belt than does the engagement of snap portions 340 and 344. Preferably, the snap option that is not being used is concealed and hidden from view by the belt when the belt is fastened. In other embodiments, the first end portion 316 can be variously sized and provided with any number of (i.e., one or more) snap options to accommodate adjustability to the length of the belt 300. Alternatively, or additionally, other suitable means can be employed at the first end portion, the second end portion, and/or the medial portion to enable selective adjustment to the functional length of the belt such as elastic straps, adjustable straps, hook and loop closures, clasps, features of the belt material itself.

With further reference to FIG. 1, the belt 100 can also include means for engaging the second end portion 120 with the first end portion 116 to enable fastening and unfastening of the belt with a single hand. A wide range of suitable fastening means can be employed for engaging the first and second end portions 116 and 120 to one another, such as hook and loop closures (e.g., Velcro® hook and loop fasteners, etc.), magnets, etc.

Figure 3:
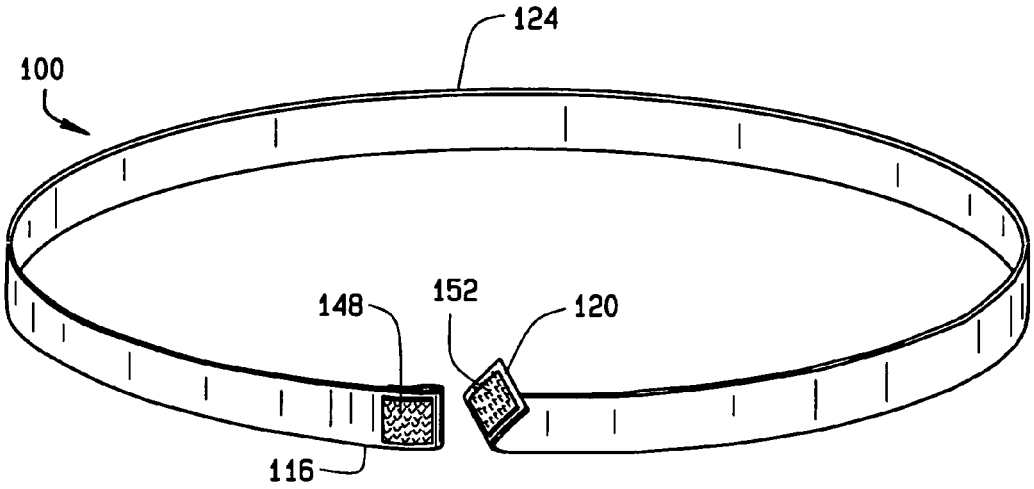
FIG. 3 is a perspective view of the belt shown in FIG. 1.
Figure 4:
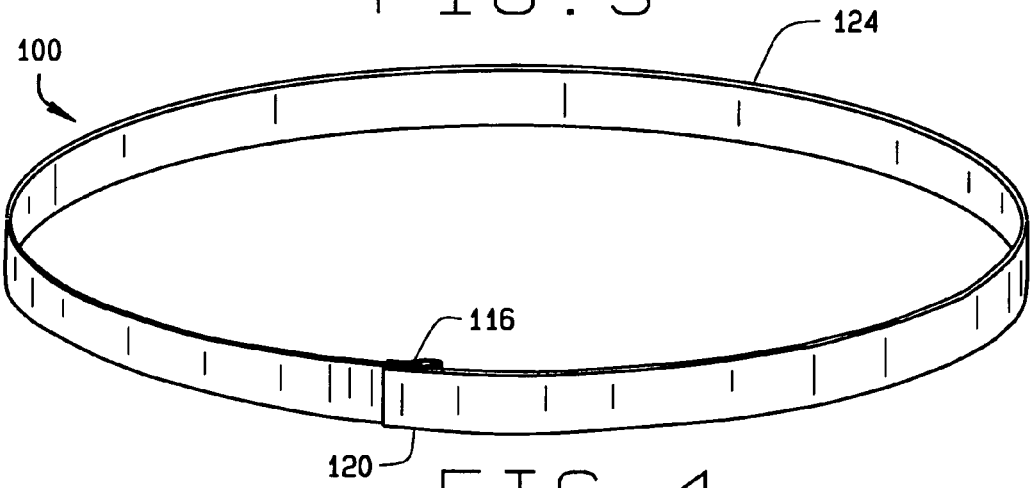
FIG. 4 is a perspective view of the belt shown in FIG. 1 wherein the belt's end portions are engaged to one another.

A shown in FIGS. 1, 3 and 5, the first and second end portions 116 and 120 include respective mating portions 148 and 152 of a hook and loop fastening system. Accordingly, the belt 100 can be fastened by a user while using only one hand. For example, a single hand can be used to maneuver the second end portion 120 relative to the first end portion 116 to tighten the belt 100 and to align and engage the mating hook and loop portions 148 and 152 with one another. In various embodiments, this maneuvering can be accomplished by a user pulling only the second end 120 in a generally continuous sweeping or arcing motion, although such is not required. Preferably, the belt 100 is adapted such that the second end portion 120, when engaged with the first end portion 116, covers up or conceals the anchoring snap 136 or other device used to anchor the first end portion 116 to the belt loop 128. It should be noted, however, that while the belt 100 is capable of being fastened with single hand, the belt 100 can also be fastened while using both hands.

Conversely, the belt 100 can be unfastened by using only one hand to pull the second end portion 120 generally outwardly from the first end portion 116 to separate and disengage the hook and loop closure members 148 and 152. It should be noted, however, that even though the belt is capable of being unfastened with a single hand, the belt 100 can also be unfastened while using both hands.

In various embodiments, the belt can include one or more indicia thereon for assisting the user in aligning the end portions of the belt for engagement. For example, the first and second end portions of a belt can define mating portions of a graphic element which cooperate to form the graphic element when the first and second end portions are properly aligned and/or engaged with one another. Accordingly, the graphic element provides a readily visible indicator of the relative alignment of the first end portion to the second end portion. The graphic element can also make the belt more visually appealing and more fun and enjoyable. Indeed, a wide range of graphic elements can be used including various geometric shapes, fanciful shapes, recognizable and well-known shapes such as stars, fish, sports balls (e.g., football, soccer ball, etc.), among others. The particular graphic element and color(s) thereof can be determined at least in part by user preference, which, in turn, can be based on any number of factors including the user's interests and the age of the user.

Figure 10:
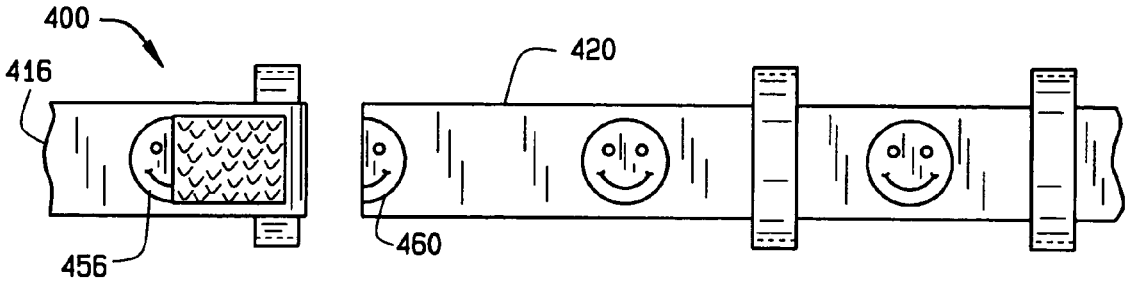
FIG. 10 is a partial view of a belt having end portions which define respective mating portions of a smiley face graphic according to an exemplary embodiment of the invention.
Figure 11:
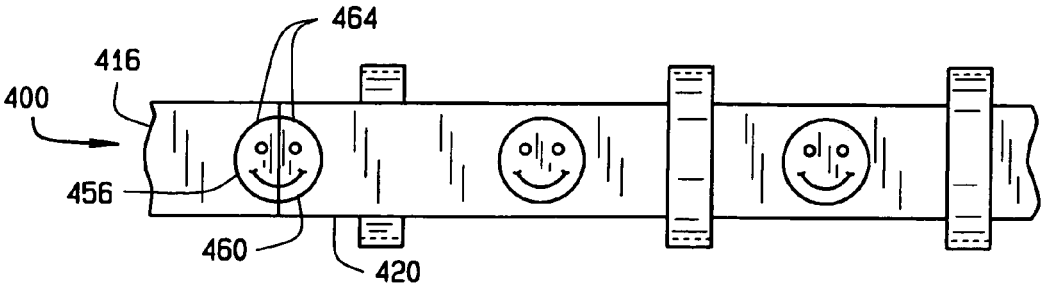
FIG. 11 is a view of the belt end portions shown in FIG. 10 illustrating the respective mating portions cooperating to form a smiley face graphic.

By way of example, FIGS. 10 and 11 illustrate an exemplary embodiment of a belt 400 that includes end portions 416 and 420 defining respective mating portions 456 and 460 of a smiley face graphic 464. The respective halves 456 and 460 cooperate to form the smiley face 464 when the end portions 416 and 420 are properly aligned and engaged with one another.

Figure 12:
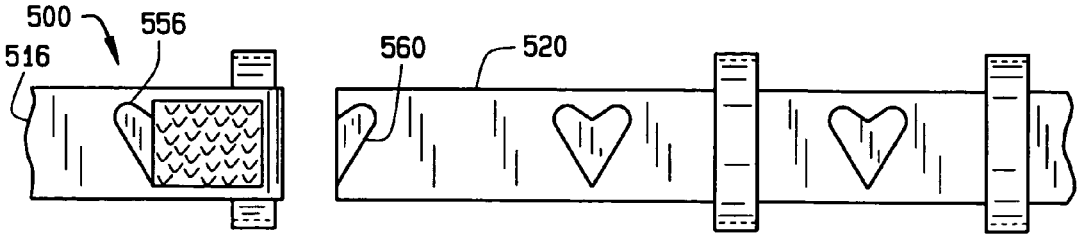
FIG. 12 is a partial view of a belt having end portions which define respective mating portions of a heart-shaped graphic according to an exemplary embodiment of the invention.
Figure 13:
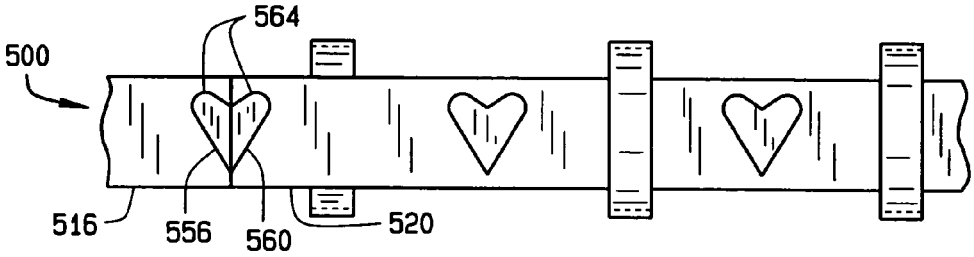
FIG. 13 is a view of the belt end portions shown in FIG. 10 illustrating the respective mating portions cooperating to form a heart-shaped graphic.

By way of further example, FIGS. 12 and 13 illustrate an exemplary embodiment of a belt 500 that includes end portions 516 and 520 defining respective mating portions 556 and 560 of a heart-shaped graphic 564. The respective portions 556 and 560 cooperate to form the heart 564 when the end portions 516 and 520 are properly aligned and engaged with one another.

In FIGS. 10 through 13, the end portions each respectively define about one-half (½) of a graphic element. Alternatively, other embodiments can include belts having end portions which define differently sized portions of a graphic element. For example, a belt can include a first end portion defining about one-third (⅓) of a graphic element, and a second end portion defining the other two-third (⅔) portion of the graphic element.

Figure 14:
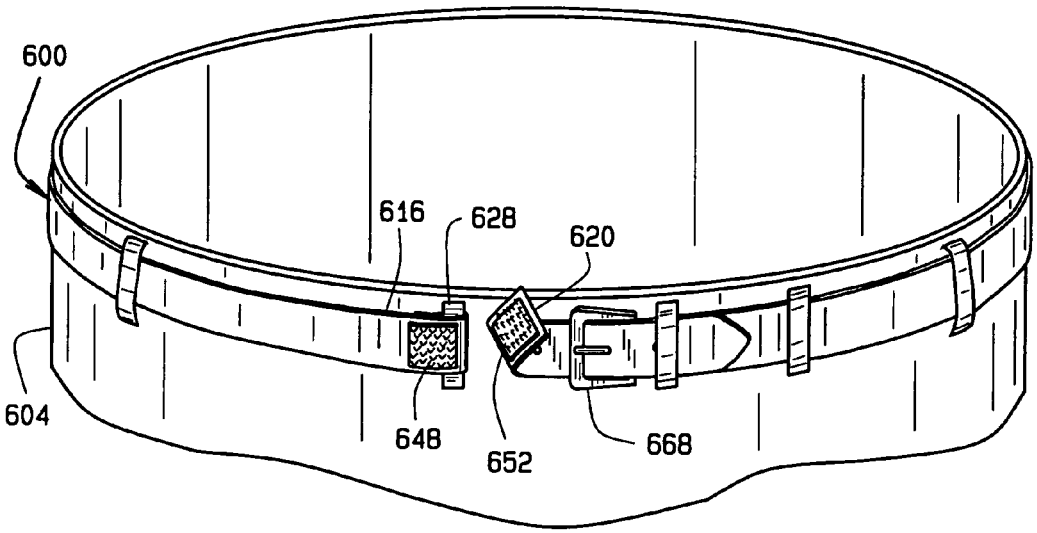
FIG. 14 is a perspective view of a belt including a faux buckle and being used with a garment according to an exemplary embodiment of the invention.
Figure 15:
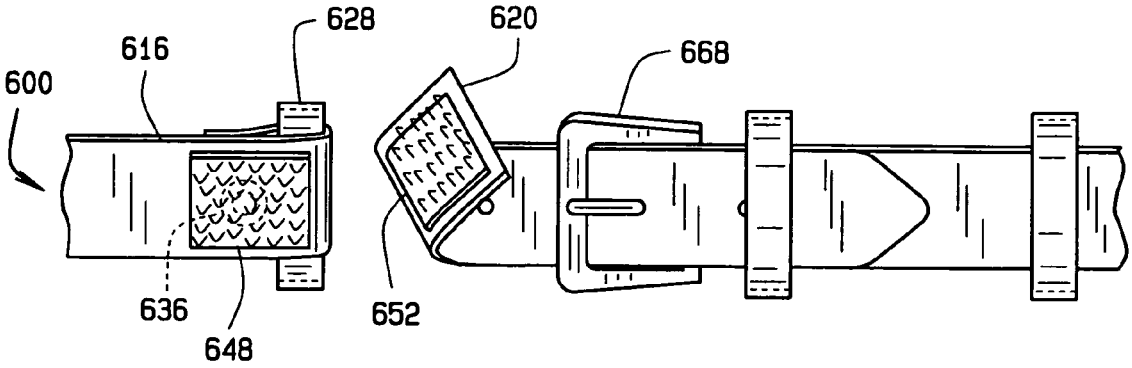
FIG. 15 is a partial view of the belt shown in FIG. 14 illustrating the belt's end portions.
Figure 16:
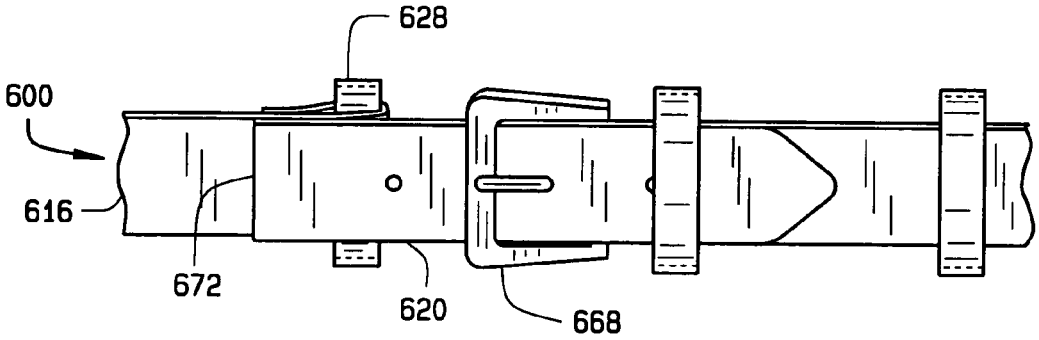
FIG. 16 is a partial view of the belt shown in FIG. 14 illustrating the belt's end portions engaged to one another.

FIGS. 14 through 16 illustrate another exemplary embodiment of a belt 600 being used with a pair of pants 604. As shown, the belt 600 includes a faux buckle 668 disposed adjacent or at the second end portion 620. The faux buckle 620 can be advantageous for formal occasions, such as weddings, office parties, etc. As shown in FIG. 15, the second end portion 620 is removably engageable to the first end portion 616 via respective mating connector portions 648 and 652 (e.g., Velcro®) hook and loop fasteners, magnets, snaps, buttons, etc.). The first end portion 616 is anchored to the belt loop 628, for example, by looping and then engaging the first end portion 616 upon itself using a snap 636 or other suitable attachment means. The belt 600 can be opened or unfastened by pulling on the second end portion 620, for example at its edge 672 with only one hand to disengage the mating connector portions 648 and 652.

The various features (e.g., first and second end portions, medial portion, attachment devices, graphic elements, decorative items, faux buckle, etc.) of the belts 100, 200, 300, 400, 500, 600 can be designed (e.g., sized, type selection, material selections, etc.) in accordance with user preferences and/or the particular type, size, and/or style of garment with which the belt will be used. For example, the length and width of a belt can depend at least in part on the user's waist size and size of the garment's belt loop.

In various embodiments of the invention, a belt can be formed from one or more materials selected from a wide range of suitable materials, such as leather, fabric, plastic, cotton, metals, combinations thereof, among others. The particular materials used for a belt can depend at least in part on user preference and the type and/or style of garment with which the belt will be used. For example, an exemplary embodiment includes a belt formed of cotton webbing with a metal trim, such as printed grosgrain ribbon.

In various embodiments of the invention, a belt can include an exterior surface comprising any of wide range of colors and/or color combinations. For example, an exemplary embodiment includes attachment devices that are a different color than the material forming the belt.

In various embodiments of the invention, a belt can include indicia or graphic elements (e.g., FIGS. 10 through 13) for guiding and assisting the user in aligning and engaging the end portions of the belt. In addition, or as alternative to, various embodiments of the invention can also include a belt that displays indicia wherein the indicia makes the belt more visually appealing, more fun and enjoyable, and/or suitable for advertisement purposes. A wide range of indicia can be displayed by a belt including graphic images, graphic elements, designs, artwork, distinctive marks, alphanumeric characters, sports team insignias, names, monograms, photographs, identifying symbols, trademarks, trade names, service marks, company logos, among others.

In one exemplary embodiment of the invention, a belt includes an exterior surface defining the English alphabet (e.g., printed or cursive ABCs). In another exemplary embodiment, a belt includes an exterior surface decorated to resemble a tape measure or ruler.

In another form, the invention provides methods of using a belt with a garment having a plurality of belt loops. In an exemplary implementation, a method generally includes grounding or anchoring a first end portion of the belt to one of the garment's belt loops. The method can also include positioning the belt through the garment's other belt loops. By way example, these operations can be performed by the wearer, a parent, a caregiver, among others, prior to or after the garment is being worn. By way of further example, the anchoring can include the wearer, parent or caregiver looping the belt's first end portion generally about one belt loop, and engaging the first end portion upon itself, for example with snaps, Velcro® hook and loop fasteners, magnets, buttons, etc.

The method can also include the wearer, caregiver or parent adjusting the functional length of the belt, for example, by selectively looping and engaging a specific length of the first end portion upon itself. For example, the caregiver or parent can select from amongst available snap options 340 and 340', as shown in FIG. 9 and described above.

The method can also include fastening the belt by using only one hand to engage the second end portion with the first end portion. For example, the wearer of the belt can pull the free or second end portion of the belt and then attach the second end portion to the first end portion. It should be noted, however, that while the belt is capable of being fastened with a single hand, the belt can also be fastened by using both hands.

The method can also include unfastening the belt by using only one hand to disengage the second end portion from the first end portion. For example, the wearer of the belt can pull the second end portion outwardly away from the first end portion to disengage the second end portion from the first end portion, thereby opening or unfastening the belt. It should be noted, however, that while the belt is capable of being unfastened with a single hand, the wearer might also decide to use both hands to unfasten the belt.

Eventually, the belt can be removed from the garment by a parent, caregiver, the wearer of the belt, among others, for example, when the belt or garment needs to be washed or when the belt needs to be put on a different garment.

By providing belts that can relatively easily be fastened or unfastened while using only one hand, various implementations of the invention can allow persons having limited or no bi-manual dexterity (e.g., from disabilities due illness, age, or other causes) to participate in a greater range of normal activities without, or at least with less, assistance. For example, implementations of the present invention can allow disabled persons to wear more conventional garments and/or use a restroom independently as a result of being able to lower, raise, and adjust their pants on their own.

Implementations of the invention are applicable to a wide range of garments and clothing apparel such as pants, trousers, shorts, dresses, skirts, and the like. Accordingly, the specific references to pants herein should not be construed as limiting the scope of the present invention to use with only pants or to any other specific form/type of garment.

The description of the invention is merely exemplary in nature and is in no way intended to limit the invention, its application, or uses. Thus, variations that do not depart from the substance of the invention are intended to be within the scope of the invention. Such variations are not to be regarded as a departure from the spirit and scope of the invention.

What is claimed:

1. A method of using a belt having generally opposite first and second end portions with a garment having one or more belt loops, the method comprising looping the first end portion generally about one of said belt loops, engaging the first end portion upon itself, positioning the belt through the other of said belt loops, and fastening the belt by using only one hand to engage the second end portion with the first end portion, whereby the belt encircles a waist of a wearer of the garment.

2. The method of claim 1, wherein the method includes adjusting a functional length of the belt by selectively looping and engaging a specific length of the first end portion upon itself.

3. The method of claim 1, wherein the method further includes unfastening the belt by using only one hand to disengage the second end portion from the first end portion.

4. The method of claim 1, wherein fastening the belt includes positioning the second end portion relative to the first portion to align one or more indicia defined by the second end portion with one or more corresponding indicia defined by the first end portion.

5. The method of claim 1, wherein the first and second portions define corresponding graphic element portions which cooperate to form a graphic element when the first and second end portions are aligned with one another, and wherein fastening the belt includes positioning the second end portion relative to the first portion to align the graphic element portions to form the graphic element.

6. The method of claim 1, wherein fastening the belt includes fastening the belt off-center relative to the garment.

7. The method of claim 1, wherein fastening the belt includes maneuvering only the second end portion relative to the first end portion.

8. The method of claim 7, wherein maneuvering only the second end portion includes pulling only the second end portion with only one hand in a generally continuous motion.

9. The method of claim 7, wherein maneuvering only the second end portion includes pulling only the second end portion with only one hand to tighten the belt and align the second end portion for engagement with the first end portion.

10. A method of using a belt having generally opposed first and second end portions with a garment having a plurality of belt loops, the method comprising anchoring the first end portion of the belt to a belt loop, positioning the belt around the garment, and fastening the belt by using only one hand to engage the second end portion with the first end portion, whereby the belt encircles a waist of a wearer of the garment.

11. The method of claim 10, wherein anchoring the first end portion includes looping the first end portion generally about one of said belt loops, and engaging the first end portion upon itself.

12. The method of claim 11, wherein the method includes adjusting a functional length of the belt by selectively looping and engaging a specific length of the first end portion upon itself.

13. The method of claim 10, wherein anchoring the first end portion includes anchoring the first end portion to one of said belt loops, and wherein positioning the belt generally around the garment includes positioning the belt through the other of said belt loops.

14. The method of claim 10, wherein fastening the belt includes maneuvering only the second end portion relative to the first end portion.

15. The method of claim 14, wherein maneuvering only the second end portion includes pulling only the second end portion with only one hand in a generally continuous motion.

16. The method of claim 14, wherein maneuvering only the second end portion includes pulling only the second end portion with only one hand to tighten the belt and align the second end portion for engagement with the first end portion.

17. The method of claim 10, wherein the method further includes unfastening the belt by using only one hand to disengage the second end portion from the first end portion.

18. The method of claim 17, wherein unfastening the belt includes pulling only the second end portion with only one hand in a generally continuous motion.

19. The method of claim 10, wherein fastening the belt includes positioning the second end portion relative to the first portion to align one or more indicia defined by the second end portion with one or more corresponding indicia defined by the first end portion.

20. The method of claim 10, wherein the first and second portions define corresponding graphic element portions which cooperate to form a graphic element when the first and second end portions are aligned with one another, and wherein fastening the belt includes positioning the second end portion relative to the first portion to align the graphic element portions to form the graphic element.

21. The method of claim 10, wherein fastening the belt includes fastening the belt off-center relative to the garment.

22. A belt for use with a garment having a plurality of belt loops, the belt comprising generally opposed first and second end portions, the first end portion being adapted to be looped generally about one of said belt loops and engaged upon itself, the belt being sized to be positioned through the other of said belt loops to thereby encircle a waist of a wearer of the garment, the second end portion being engageable with the first end portion to enable fastening of the belt with only one hand.

23. The belt of claim 22, wherein the belt includes a plurality of attachment devices for selectively looping and engaging a plurality of specific lengths of the first end portion upon itself to adjust a functional length of the belt.

24. The belt of claim 22, wherein the belt includes means for adjusting a functional length of the belt.

25. The belt of claim 22, wherein the first and second end portions define corresponding portions of a graphic element which cooperate to form the graphic element when the first and second end portions are aligned with one another.

26. The belt of claim 22, wherein the belt is adapted to be fastened off-center relative to the garment.

27. In combination with a garment having a plurality of belt loops, a belt comprising generally opposed first and second end portions, the first end portion looped generally about one of said belt loops and engaged upon itself, the belt being positioned through the other of said belt loops to thereby encircle a waist of a wearer of the garment, the second end portion being engageable with the first end portion to enable fastening of the belt with only one hand.

28. The combination of claim 27, wherein the belt includes a plurality of attachment devices for selectively looping and engaging a plurality of specific lengths of the first end portion upon itself to adjust a functional length of the belt.

29. The combination of claim 27, wherein the belt includes means for adjusting a functional length of the belt.

30. The combination of claim 27, wherein the first and second end portions define corresponding portions of a graphic element which cooperate to form the graphic element when the first and second end portions are aligned with one another.

31. The combination of claim 27, wherein the belt is adapted to be fastened off-center relative to the garment.

* * * * *